US008057267B2

(12) United States Patent
Johnescu

(10) Patent No.: US 8,057,267 B2
(45) **Date of Patent: *Nov. 15, 2011**

(54) ORTHOGONAL HEADER

(75) Inventor: Douglas M. Johnescu, York, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/528,906

(22) PCT Filed: Feb. 26, 2008

(86) PCT No.: PCT/US2008/002476

§ 371 (c)(1),
(2), (4) Date: Aug. 27, 2009

(87) PCT Pub. No.: WO2008/106096

PCT Pub. Date: Sep. 4, 2008

(65) Prior Publication Data

US 2010/0048067 A1 Feb. 25, 2010

Related U.S. Application Data

(63) Continuation-in-part of application No. 11/680,210, filed on Feb. 28, 2007, now Pat. No. 7,422,444.

(51) Int. Cl.
*H01R 13/40* (2006.01)

(52) U.S. Cl. ..... 439/733.1; 439/751

(58) Field of Classification Search ..... 439/733.1, 439/751, 84

See application file for complete search history.

(56) References Cited

U.S. PATENT DOCUMENTS

| | | | |
|---|---|---|---|
| 2,664,552 | A | 12/1953 | Ericsson et al. |
| 2,849,700 | A | 4/1958 | Perkin |
| 2,858,372 | A | 10/1958 | Kaufman |
| 3,115,379 | A | 12/1963 | McKee |
| 3,286,220 | A | 11/1966 | Marley et al. |
| 3,343,120 | A | 9/1967 | Whiting |
| 3,482,201 | A | 12/1969 | Schneck |
| 3,538,486 | A | 11/1970 | Shlesinger, Jr. |
| 3,591,834 | A | 7/1971 | Kolias |
| 3,641,475 | A | 2/1972 | Irish et al. |
| 3,663,925 | A | 5/1972 | Proctor |
| 3,669,054 | A | 6/1972 | Desso et al. |
| 3,701,076 | A | 10/1972 | Irish |
| 3,748,633 | A | 7/1973 | Lundergan |
| 3,827,005 | A | 7/1974 | Friend |
| 3,867,008 | A | 2/1975 | Gartland, Jr. |

(Continued)

OTHER PUBLICATIONS

Cartier, M. et al., "Optimized Signal Path for Orthogonal Systems Architectures," DesignCon, 2005, 24 pages.
U.S. Appl. No. 60/839,071, filed Aug. 21, 2006, Minich.
U.S. Appl. No. 60/846,711, filed Sep. 22, 2006, Mortion.

*Primary Examiner* — Khiem Nguyen
(74) *Attorney, Agent, or Firm* — Woodcock Washburn LLP

(57) ABSTRACT

An electrically-conductive contact for an electrical connector is disclosed. Such a contact may include a lead portion, an offset portion extending from an end of the lead portion, and a mounting portion that may extend from a distal end of the offset portion. The lead portion and the distal end of the offset portion may each define an imaginary plane that may intersect at a non-zero, acute angle. An electrical connector that is suitable for orthogonal connector applications may include a connector housing securing two such electrical contacts. The distance between the respective mounting portions of the two such contacts may be defined independently of the contact pitch.

13 Claims, 12 Drawing Sheets

U.S. PATENT DOCUMENTS 4,030,792 A 6/1977 Fuerst
4,076,362 A 2/1978 Ichimura
4,159,861 A 7/1979 Anhalt
4,232,924 A 11/1980 Kline et al.
4,260,212 A 4/1981 Ritchie et al.
4,288,139 A 9/1981 Cobaugh et al.
4,383,724 A 5/1983 Verhoeven
4,402,563 A 9/1983 Sinclair
4,482,937 A 11/1984 Berg
4,523,296 A 6/1985 Healy, Jr.
4,560,222 A 12/1985 Dambach
4,664,458 A 5/1987 Worth
4,717,360 A 1/1988 Czaja
4,776,803 A 10/1988 Pretchel et al.
4,815,987 A 3/1989 Kawano et al.
4,867,713 A 9/1989 Ozu et al.
4,898,539 A 2/1990 Glover et al.
4,900,271 A 2/1990 Colleran et al.
4,907,990 A 3/1990 Bertho et al.
4,913,664 A 4/1990 Dixon et al.
4,917,616 A 4/1990 Demler, Jr. et al.
4,973,271 A 11/1990 Ishizuka et al.
4,997,390 A 3/1991 Scholz et al.
5,004,426 A 4/1991 Barnett
5,046,960 A 9/1991 Fedder
5,055,054 A 10/1991 Doutrich
5,065,282 A 11/1991 Polonio
5,066,236 A 11/1991 Broeksteeg
5,077,893 A 1/1992 Mosquera et al.
5,094,623 A 3/1992 Scharf et al.
5,098,311 A 3/1992 Roath et al.
5,127,839 A 7/1992 Korsunsky et al.
5,163,849 A 11/1992 Fogg et al.
5,167,528 A 12/1992 Nishiyama et al.
5,169,337 A 12/1992 Ortega et al.
5,174,770 A 12/1992 Sasaki et al.
5,181,855 A 1/1993 Mosquera et al.
5,238,414 A 8/1993 Yaegashi et al.
5,254,012 A 10/1993 Wang
5,257,941 A 11/1993 Lwee et al.
5,274,918 A 1/1994 Reed
5,286,212 A 2/1994 Broeksteeg
5,288,949 A 2/1994 Crafts
5,302,135 A 4/1994 Lee
5,342,211 A 8/1994 Broeksteeg
5,356,300 A 10/1994 Costello et al.
5,357,050 A 10/1994 Baran et al.
5,387,111 A 2/1995 DeSantis et al.
5,395,250 A 3/1995 Englert, Jr. et al.
5,429,520 A 7/1995 Morlion et al.
5,431,578 A 7/1995 Wayne
5,475,922 A 12/1995 Tamura et al.
5,522,727 A 6/1996 Saito et al.
5,558,542 A 9/1996 O'Sullivan et al.
5,575,688 A 11/1996 Crane, Jr.
5,586,908 A 12/1996 Lorrain
5,586,914 A 12/1996 Foster, Jr. et al.
5,590,463 A 1/1997 Feldman et al.
5,609,502 A 3/1997 Thumma
5,634,821 A 6/1997 Crane, Jr.
5,637,019 A 6/1997 Crane, Jr. et al.
5,672,064 A 9/1997 Provencher et al.
5,697,799 A 12/1997 Consoli et al.
5,730,609 A 3/1998 Harwath
5,741,144 A 4/1998 Elco et al.
5,741,161 A 4/1998 Cahaly et al.
5,795,191 A 8/1998 Preputnick et al.
5,817,973 A 10/1998 Elco
5,833,475 A 11/1998 Mitra
5,860,816 A 1/1999 Provencher et al.
5,871,362 A 2/1999 Campbell et al.
5,876,222 A 3/1999 Gardner et al.
5,887,158 A 3/1999 Sample
5,893,761 A 4/1999 Longueville
5,902,136 A 5/1999 Lemke et al.
5,904,581 A 5/1999 Pope et al.
5,908,333 A 6/1999 Perino et al.
5,938,479 A 8/1999 Paulson
5,961,355 A 10/1999 Morlion et al.
5,971,817 A 10/1999 Longueville
5,980,321 A 11/1999 Cohen et al.
5,984,690 A 11/1999 Riechelmann et al.
5,992,953 A 11/1999 Rabinovitz
5,993,259 A 11/1999 Stokoe et al.
6,022,227 A 2/2000 Huang
6,042,427 A 3/2000 Adriacnssens et al.
6,050,862 A 4/2000 Ishii
6,086,386 A 7/2000 Fjelstad et al.
6,116,926 A 9/2000 Ortega et al.
6,179,663 B1 1/2001 Bradley et al.
6,227,882 B1 5/2001 Ortega et al.
6,293,827 B1 9/2001 Stokoe
6,299,483 B1 10/2001 Cohen et al.
6,302,711 B1 10/2001 Ito
6,328,602 B1 12/2001 Yamasaki et al.
6,375,478 B1 4/2002 Kikuchi
6,379,188 B1 4/2002 Cohen et al.
6,414,248 B1 7/2002 Sundstrom
6,464,529 B1 10/2002 Jensen et al.
6,503,103 B1 1/2003 Cohen et al.
6,506,076 B2 1/2003 Cohen et al.
6,528,737 B1 3/2003 Kwong et al.
6,540,522 B2 4/2003 Sipe
6,551,140 B2 4/2003 Billman et al.
6,572,409 B2 6/2003 Nitta et al.
6,592,381 B2 7/2003 Cohen
6,672,907 B2 1/2004 Azuma
6,692,272 B2 2/2004 Lemke et al.
6,695,627 B2 2/2004 Ortega et al.
6,736,664 B2 5/2004 Ueda et al.
6,746,278 B2 6/2004 Nelson et al.
6,749,439 B1 6/2004 Potter et al.
6,764,341 B2 7/2004 Lappoehn
6,808,420 B2 10/2004 Whiteman, Jr.
6,833,615 B2 12/2004 Geng
6,843,686 B2 1/2005 Ohnishi et al.
6,848,944 B2 2/2005 Evans
6,851,980 B2 2/2005 Nelson
6,893,686 B2 5/2005 Egan
6,913,490 B2 7/2005 Whiteman, Jr. et al.
6,918,789 B2 7/2005 Lang et al.
6,945,796 B2 9/2005 Bassler et al.
6,960,103 B2 11/2005 Tokunaga
6,979,215 B2 12/2005 Avery
6,981,883 B2 1/2006 Raistrick et al.
6,994,569 B2 2/2006 Minich et al.
7,001,188 B2 2/2006 Koyayashi
7,021,975 B2 4/2006 Lappohn
7,094,102 B2 8/2006 Cohen et al.
7,108,556 B2 9/2006 Cohen et al.
7,139,176 B2 11/2006 Taniguchi
7,153,162 B2 12/2006 Mizumura
7,239,526 B1 7/2007 Bibee
7,331,802 B2 2/2008 Rothermel
7,331,830 B2 2/2008 Minich
7,344,391 B2 3/2008 Minich
7,422,444 B1 * 9/2008 Johnescu ..... 439/78
7,448,909 B2 11/2008 Regnier
7,524,209 B2 4/2009 Hull
2003/0116857 A1 6/2003 Taniguchi
2004/0224559 A1 11/2004 Nelson et al.
2004/0235321 A1 11/2004 Mizumura
2005/0032401 A1 2/2005 Kobayashi
2005/0170700 A1 8/2005 Shuey et al.
2005/0196987 A1 9/2005 Shuey et al.
2005/0215121 A1 9/2005 Tokunaga
2005/0227552 A1 10/2005 Yamashita et al.
2006/0024983 A1 2/2006 Cohen
2006/0068641 A1 3/2006 Hull
2006/0073709 A1 4/2006 Reid
2006/0228912 A1 10/2006 Morlion et al.
2006/0232301 A1 10/2006 Morlion et al.

* cited by examiner

ORTHOGONAL HEADER

CROSS-REFERENCE TO RELATED APPLICATIONS

This application is the National Stage of International Application No. PCT/US2008/002476, filed Feb. 26, 2008, which is a continuation-in-part of U.S. application Ser. No. 11/680,210, filed Feb. 28, 2007, now U.S. Pat. No. 7,422,444, granted Sep. 9, 2008, the disclosures of which are incorporated herein by reference in their entirety.

BACKGROUND

In circuit board connector applications where adjacent lead contacts form a signal pair, the spacing between the contact mounts at the circuit board may affect signal integrity. For example, the spacing may affect skew, cross-talk, and impedance.

In some orthogonal applications, the contact mounts for a signal pair may be oriented at a 45° angle to the contacts. For example, in an orthogonal mid-plane architecture, two daughter boards, orthogonal to each other, may each connect to each side of a mid-plane circuit board. The connectors may mount to the mid-plane through common vias. Because each connector may provide a 45° difference between the contact mounts and the contacts, the connectors that mate to the daughter boards may be 90° rotated relative to each other. For each connector to achieve this 45° angle, each lead of a signal pair may include an transverse offset, or bend, in opposite directions such that the transverse offset matches the contact pitch.

Generally, connectors are manufactured in families with compatible geometry such as common contact pitch. Where the transverse offset matches the contact pitch, a single connector family lacks the flexibility to define a via spacing specific to the signal integrity and physical design requirements of different applications. Thus, there is a need for an orthogonal connector where the spacing between the contact mounts may be varied independently of the contact pitch.

SUMMARY

An electrically-conductive contact for an electrical connector is disclosed which may include a lead portion, an offset portion extending from an end of the lead portion, and a mounting portion that may extend from a distal end of the offset portion. The lead portion and the distal end of the offset portion may each define an imaginary plane. The two imaginary planes may intersect at a non-zero, acute angle. The offset portion may be curved.

An electrical connector is disclosed which may include a connector housing securing two electrical contacts. Each electrical contact may include a lead portion, an offset portion extending from an end of the lead portion, and a mounting portion that may extend from a distal end of the offset portion. The lead portion and the distal end of the offset portion may each define an imaginary plane. The two imaginary planes may intersect. The lead portions of each contact may be aligned in an imaginary contact plane. Each mounting portion may be positioned such that the intersection of the contact plane and an imaginary line extending between the distal tips of each mounting portion defines a substantially 45° angle as measured normal to the contact plane an imaginary line.

The distance between the respective mounting portions may be selected to match the impedance of a complementary electrical independent of the distance between the respective lead portions. The connector housing may define a mounting face for mounting to a circuit board and the respective offset portions may be substantially flush with the mounting face.

DETAILED DESCRIPTION

Figure 2A:
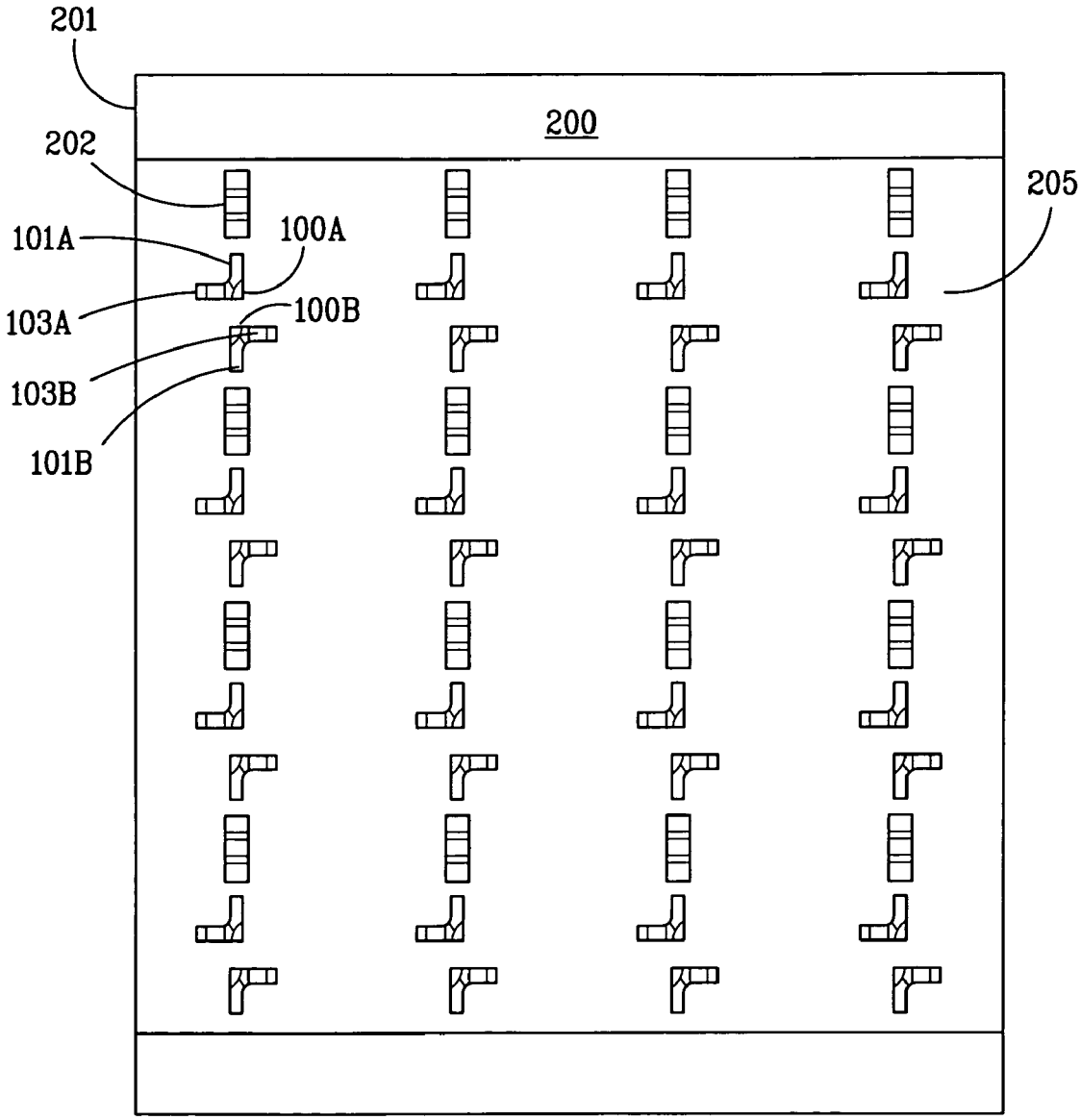
FIGS. 2A-C depict the bottom of an illustrative electrical connector in a narrow configuration in bottom, close-up, and isometric views, respectively.
Figure 4A:
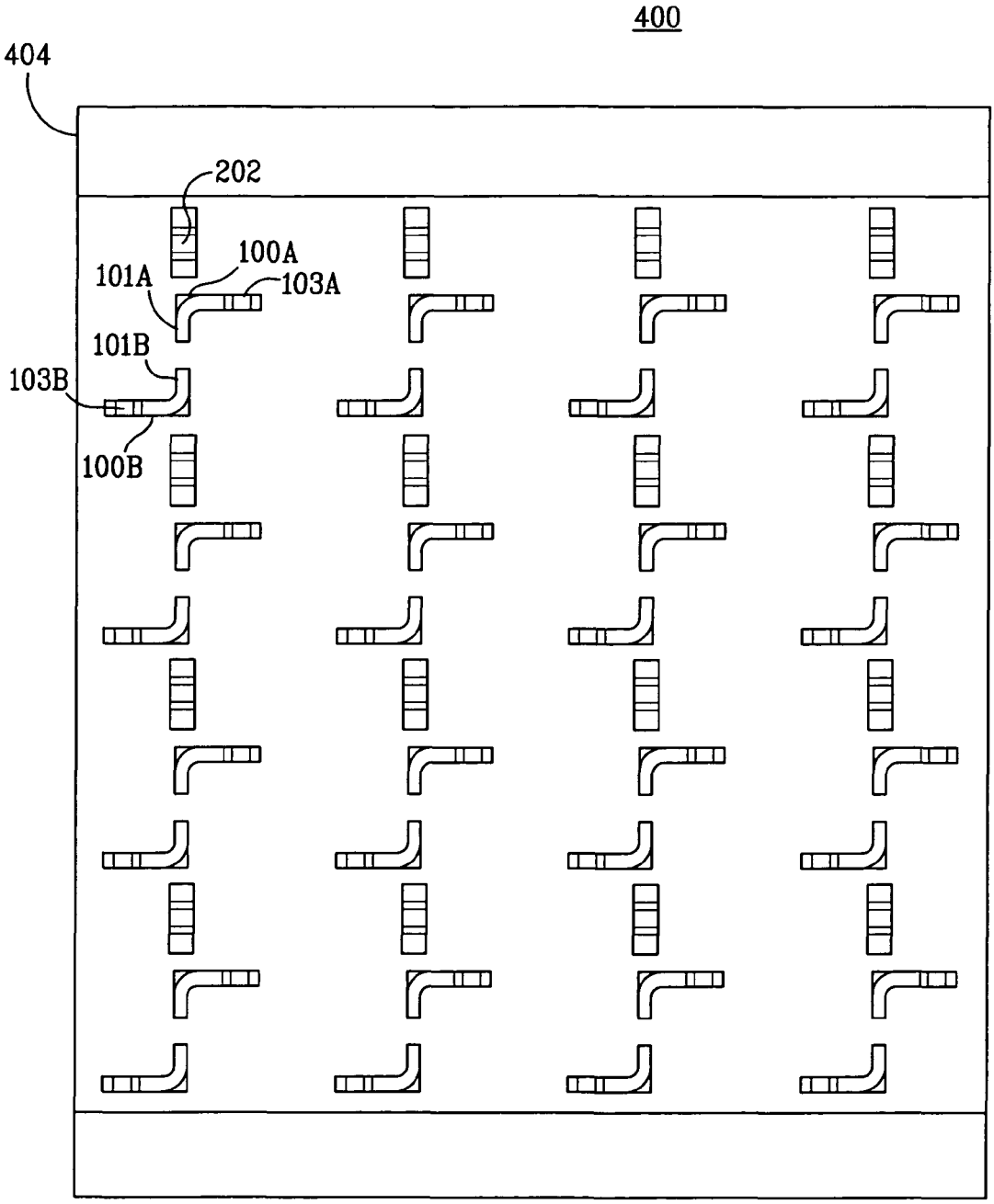
FIGS. 4A-C depict the bottom of an illustrative electrical connector in a wide configuration in bottom, close-up, and isometric views, respectively.
Figure 7A:
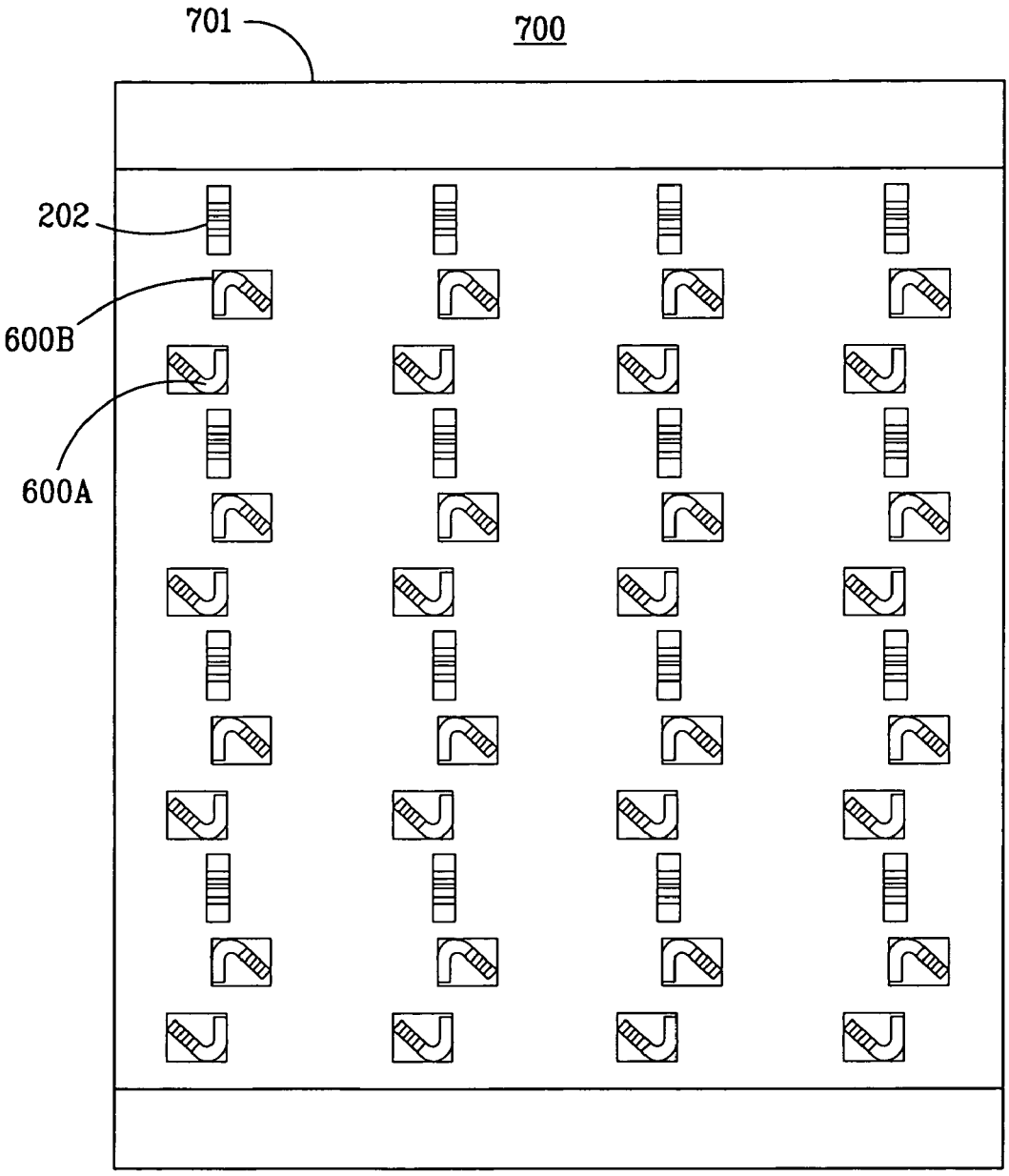
FIG. 7A-B depicts the bottom of an illustrative electrical connector in an intermediate configuration in bottom and close-up views, respectively.

One aspect of the present invention is the ability to change, tune, or otherwise change the characteristic impedance of an orthogonal printed circuit board connector footprint and maintain differential coupling through a connector housing. This can be accomplished by keeping most of the connector the same, but change the configuration, relative spacing, or orientation of the mounting portions of the differential signal pairs. In a first configuration, such as shown in FIG. 2A, the mounting portions are closer together, which increases capacitive coupling and lowers the impedance. In a second configuration, such as shown in FIG. 4A, the mounting portions are spaced farther apart, which raises the impedance as compared to the FIG. 2A embodiment. In a third configuration, such as shown in FIG. 7A, the impedance can be adjusted between the FIG. 2A embodiment and the FIG. 7A embodiment.

For example, a method to adjust electrical characteristics of an orthogonal printed circuit board connector footprint may comprise the steps of making a first electrical connector comprising two electrically-conductive contacts aligned edge to edge to define a differential signal pair and separated from one another by a first distance, making a second electrical connector comprising two second electrically-conductive contacts aligned edge to edge or broadside to broadside to define a second differential signal pair and also separated from one another by the first distance, offsetting mounting portions of the two electrically-conductive contacts a first distance with respect to each other to form a first connector footprint that corresponds to a first substrate footprint with a first impedance and offsetting second mounting portions of the two second electrically-conductive contacts a second distance with respect to each other to form a second connector footprint that is different than the first connector footprint and corresponds to a second substrate footprint with a second impedance that is different than the first impedance. The method may also include the step of making a third electrical connector that mates with both the first electrical connector and the second electrical connector. The step of offsetting the second mounting portions of the two second electrically-conductive contacts the second distance may further comprise the steps of arranging the second mounting portions at a forty-five degree angle with respect to a centerline passing coincident with lead portions of the two electrically-conductive contacts, spacing the second mounting portions farther apart than the first distance, and/or rotating each of the two second electrically-conductive contacts 180 degrees with respect to the orientation of respective ones of the two electrically-conductive contacts.

Figure 1A:
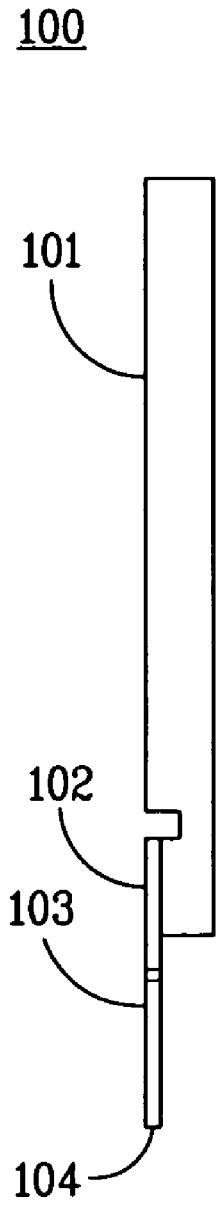
FIGS. 1A and 1B depict an illustrative electrical contact in front and side views, respectively.
Figure 1B:
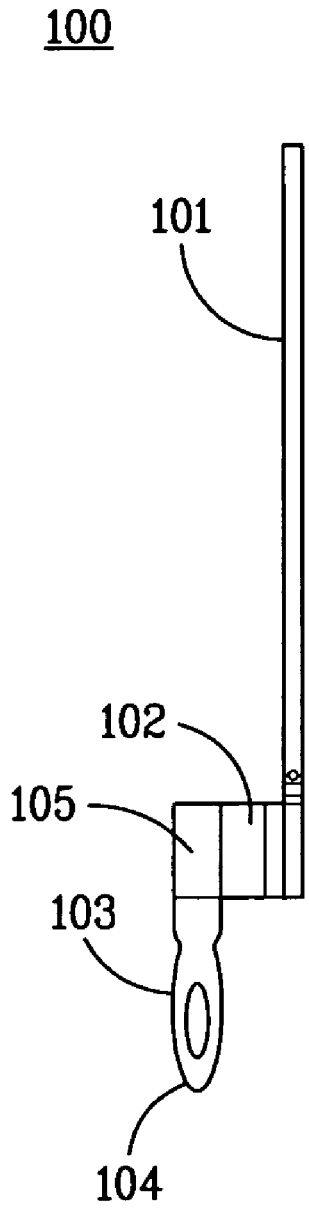

FIGS. 1A and 1B depict an illustrative electrical contact 100 in front and side views, respectively. The contact may include a lead portion 101 connected to an offset portion 102. The contact may include a mounting portion 103 also connected to the offset portion 102. The mounting portion 103 may define a distal tip 104. The contact 100 may be made of an electrical conductive material such as metal. The contact 100 may be manufactured by stamping and bending metal into the desired shape.

The lead portion 101 may extend from one end of the offset portion 102. The mounting portion 103 may extend from the other end of the offset portion 102. The lead portion 101 and the mounting portion 103 may extend in opposite directions.

The lead portion 101 and the mounting portion 103 may each define a longitudinal axis. The offset portion 102 may define the distance between the two axes. The offset portion 102 may be straight or curved. For example, the length and the shape of the offset portion 102 may define the distance and relative position of the two axes.

Further, the offset portion 102 may extend from the end of the lead portion 101 in a first direction orthogonal to the longitudinal axis of the lead portion 101. The offset portion 102 may extend from the mounting portion 103 in a second direction orthogonal to the longitudinal axis of the mounting portion.

The mounting portion 103 may be suitable for mounting to a substrate, such as a circuit board, for example. For example, the mounting portion 103 may be an eye-of-the-needle configuration suitable for securing into vias within the circuit board. In another embodiment, the mounting portion 103 may be suitable for a ball grid array (BGA). When mounted to a circuit board, the offset portion 102 of the contact 100 may abut the upper surface of the circuit board.

The lead portion 101 may be suitable for establishing an conductive connection with a complementary contact. For example, the lead portion 101 may be a plug contact or a receptacle contact.

The lead portion 101 and the mounting portion 103 may each define an imaginary plane. The two imaginary planes may intersect. In one embodiment, the two imaginary planes may intersect at a right angle. In another embodiment, the two imaginary planes may intersect at a non-right angle. The non-right angle may be an acute angle or an obtuse angle.

Generally, two instances of the contact 100 may be arranged in a signal pair in an electrical connector. While the orientation of the respective mounting portions relative to the respective lead portions may be suitable for an orthogonal application, the distance between the respective mounting portions may be selected independent of the distance between the respective lead portions. For example, the signal pair may be employed in narrow, wide, or variable configurations.

Figure 2B:
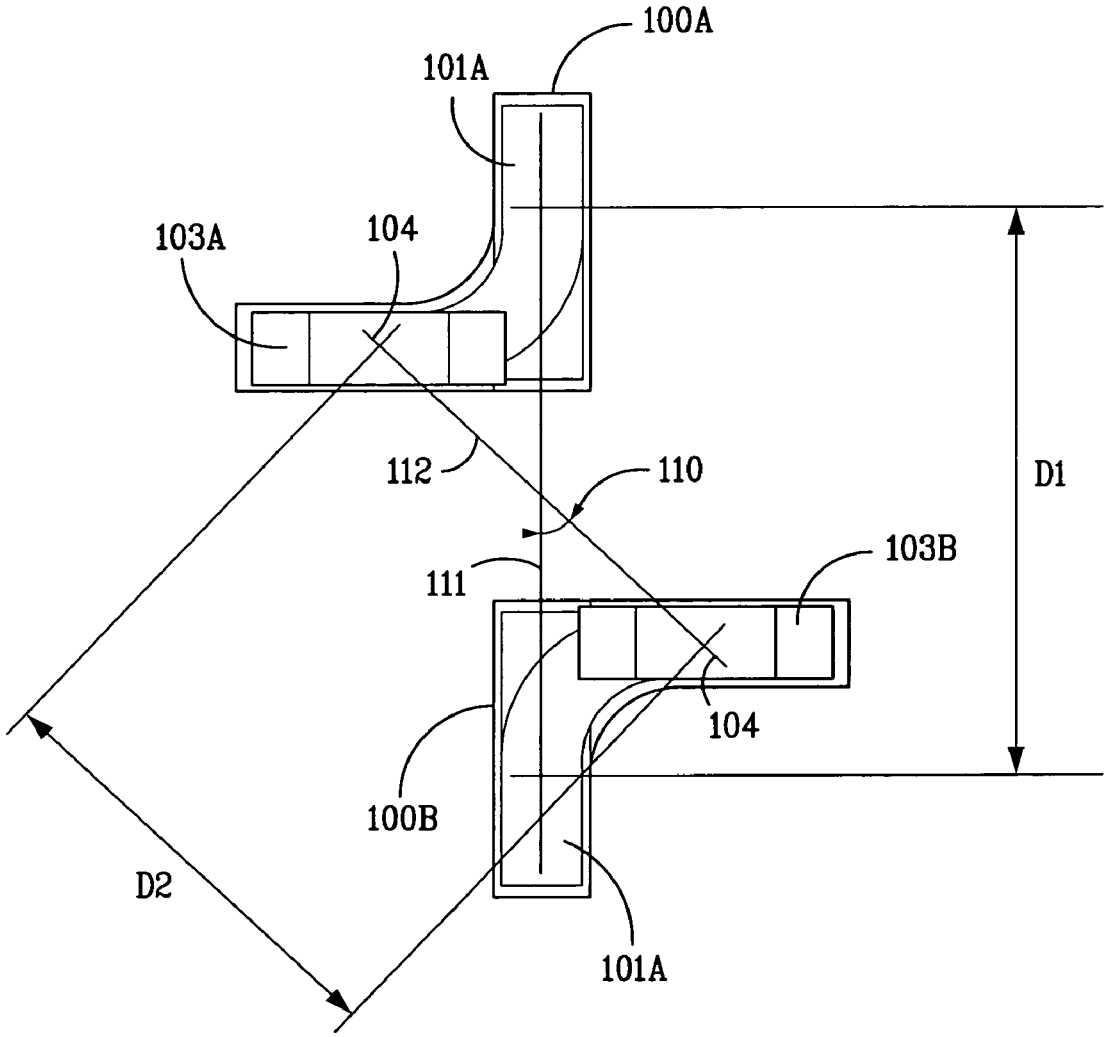
Figure 2C:
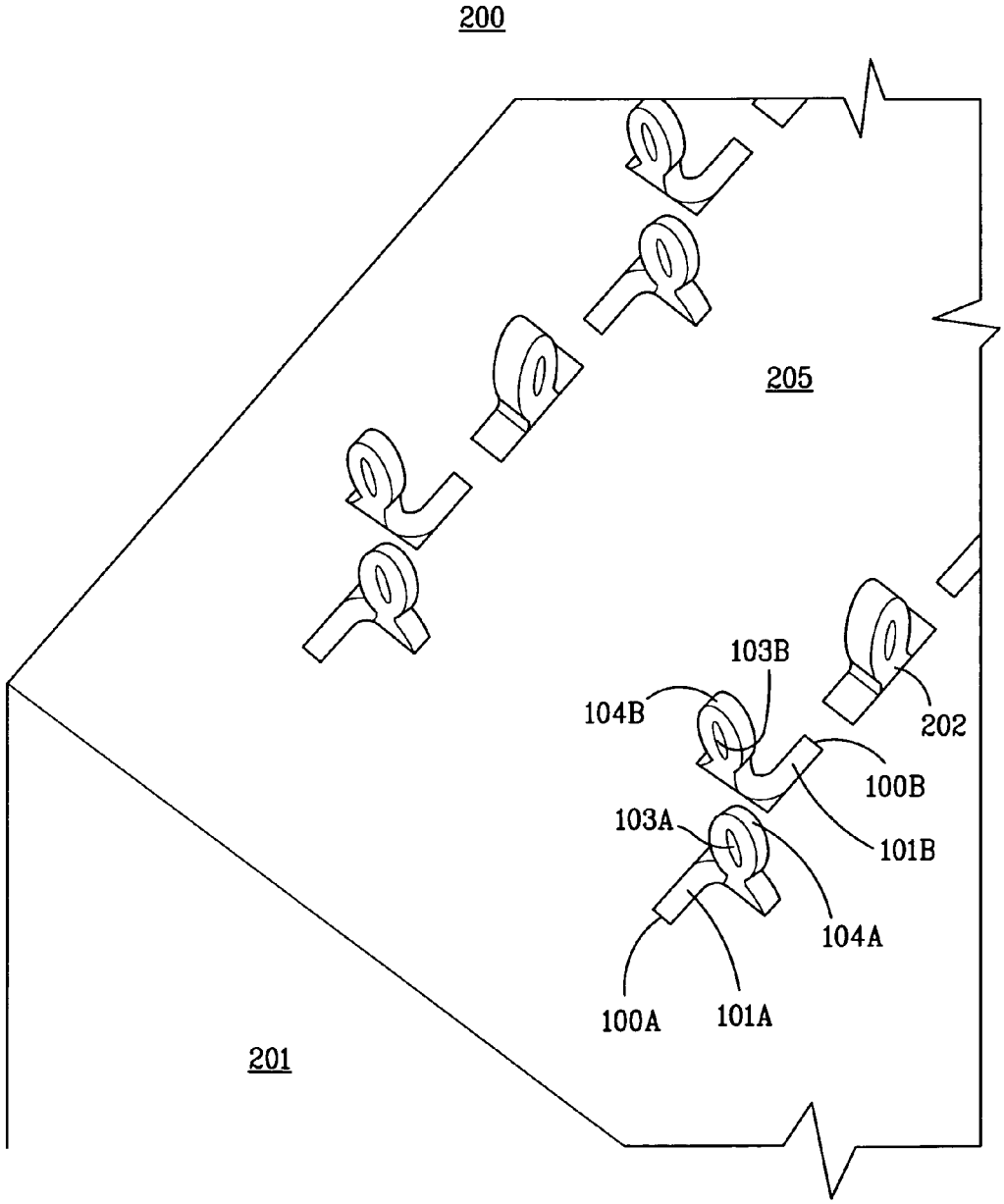

FIGS. 2A-C depict the bottom of an illustrative electrical connector 200 in a narrow configuration in bottom, close-up, and isometric views, respectively. Each contact 100A-B within the signal pair may face toward each other. For example, the first contact 100A of the signal pair may be rotated 180° with respect to the second contact 101B of the signal pair such that their respective mounting portions 103A-B are between the respective lead portions 101A-B in a narrow configuration.

The connector 200 may be suitable for an orthogonal application. The connector 200 may include signal contacts 100A-B and ground contacts 202 secured within a connector housing 201. The connector housing 201 may be made of any non-conductive material. For example, the housing 201 may be made from plastic. The connector housing 201 may have a mounting side and a mating side. The mating side (not shown) may be suitable for engaging a complementary connector. The mounting side 205 may be suitable for mounting the connector 200 to a circuit board. For example, the mounting portion 103A-B of each contact 100A-B may extend through the mounting side 205 of the connector housing 201. The offset portion (not shown) of each contact 100A-B may be flush to the mounting side 205 of the connector housing 201. When the connector 200 is mounted to the circuit board, the offset portion (not shown) of each contact 100A-B may be flush to the upper surface of the circuit board better maintaining impedance through the connector and reducing the amount of impedance mismatch.

The lead portion 101A-B of each signal contact 100A-B and each ground contact 202 may be arranged in rows and columns. Each signal contact 100A-B may be grouped into differential signal pairs. The distance between the lead portions 101A-B of each contact may be defined as the contact pitch.

Suitable for an orthogonal application, the connector 200 may enable the lead portion 101A-B of each contact 100A-B to be oriented at a substantially 45° angle from the respective mounting portions 103A-B. For example, an imaginary contact plane 111 may align the lead portion 101A of the first contact 100A and the lead portion 101B of the second contact 100B. An imaginary line 112 may extend from the distal tip 104A of the mounting portion 103A of the first contact 100A to distal tip 104B of the mounting portion 103B of the second contact 100B. The contact plane and the imaginary line may interest at an angle 110. The angle 110 measured normal to the contact plane may be substantially 45°. The angle may be substantially 45° within manufacturing tolerance.

Distance D1 may be defined as the distance measured along the contact plane between the center of the lead portion 101A of the first contact 100A and the center of the lead portion 101B of the second contact 100B. Distance D1 may measure the contact pitch as measured center-to-center.

Distance D2 may be defined as the length of the imaginary line 112. Distance D2 may be selected independent of distance D2 such that the angle 110 is maintained. Thus, the distance D2 may be selected according to signal integrity and/or physical design requirements, while maintaining the geometry suitable for orthogonal applications. Because distance D2 may be selected independent of distance D1, connectors of the same family, where contact pitch is defined for the connector family, may be manufactured for specific applications such that distance D2 may be selected to match the impedance of a specific complementary electrical device. In the configuration shown, D2 may represent the minimum hole-to-hole spacing for an orthogonal application with a D1 contact pitch. Such a configuration may allow for lower crosstalk, lower impedance, and wider area for trace routing.

Figure 3:
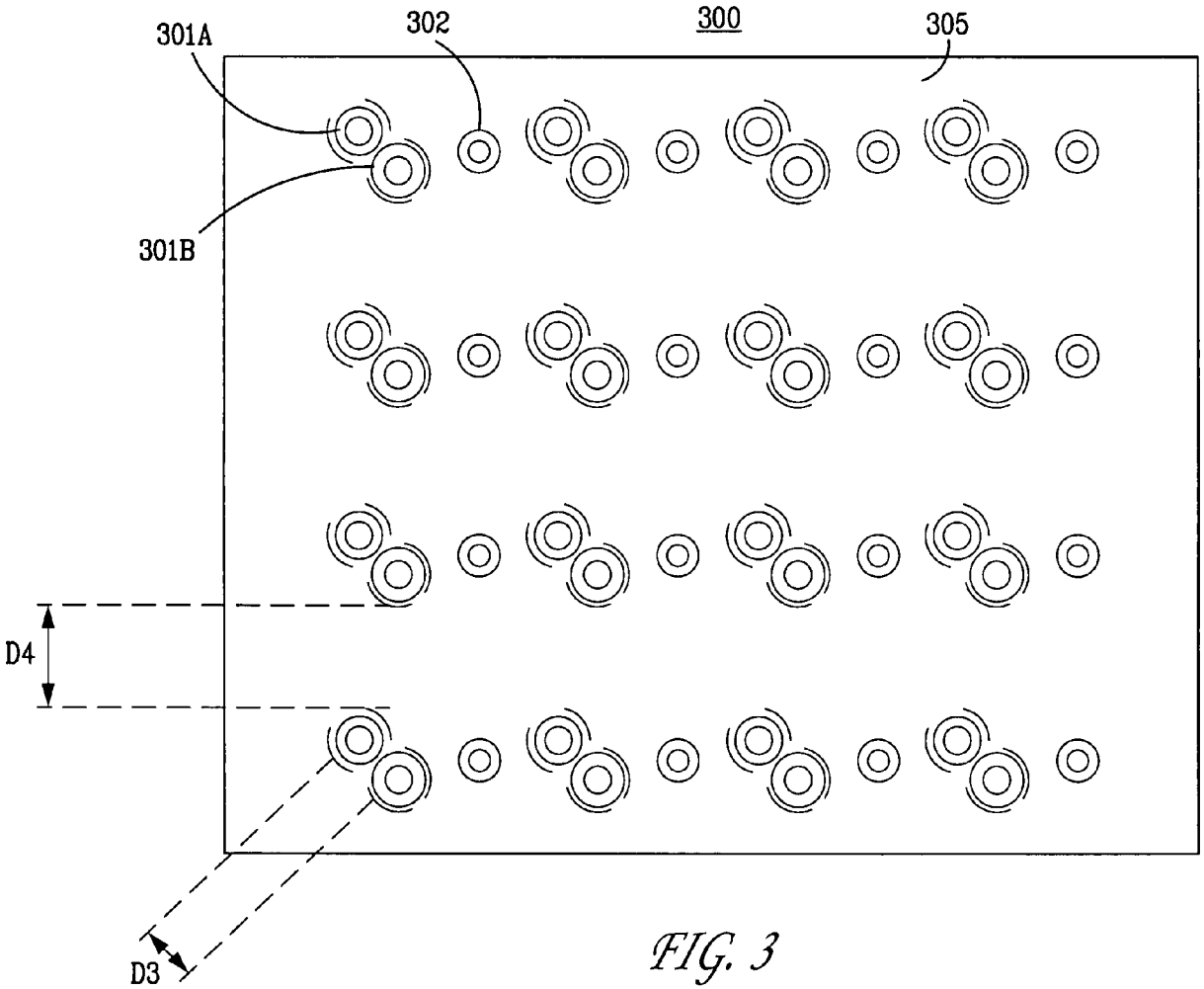
FIG. 3 depicts a illustrative circuit board layout for a narrow configuration.

FIG. 3 depicts a illustrative circuit board layout 300 for a narrow configuration. Vias 301A-B, 302 may be holes in the circuit board 305 oriented for mounting connector 200. For example, via 302 may be a hole within the circuit board 305 that receives the mounting portion of the ground contact 202, and via 301A-B may be a hole within the circuit board 305 that receives mounting portion 103A-B of the signal contacts 100A-B.

The circuit board layout 300 may define a distance D3 between vias 301A-B. Distance D3 may match the distance D2. It may be desirable to select D3 on the basis of signal integrity. For example, it may be desirable to select D3 on the basis of impedance matching.

The circuit board layout 305 may define a distance D4 between rows of vias 301A-B. Distance D4 may provide a width of circuit board that may be used for conductive traces (not shown). It may be desirable to select distance D4 to ensure adequate physical space for conductive traces. Accordingly, design requirements that influence distance D3 and distance D4 may reflect various implementations for distance D2 of the electrical connector.

Figure 4B:
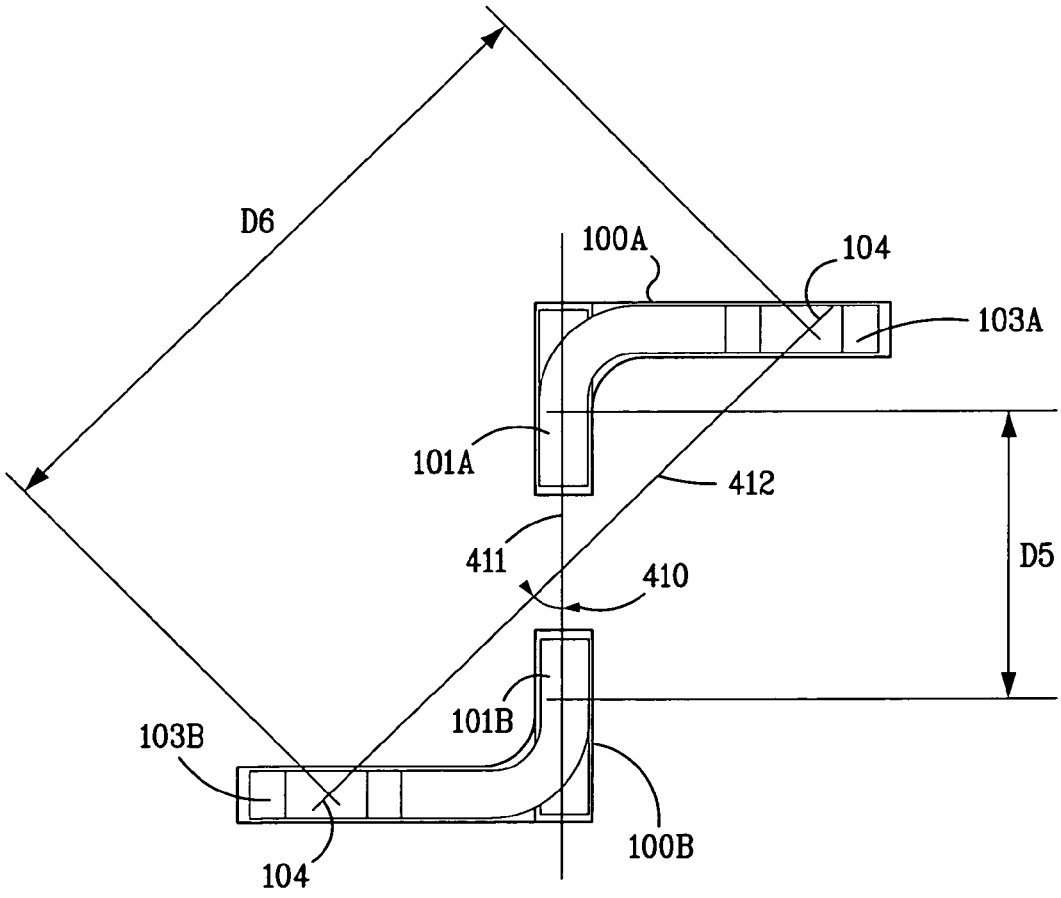
Figure 4C:
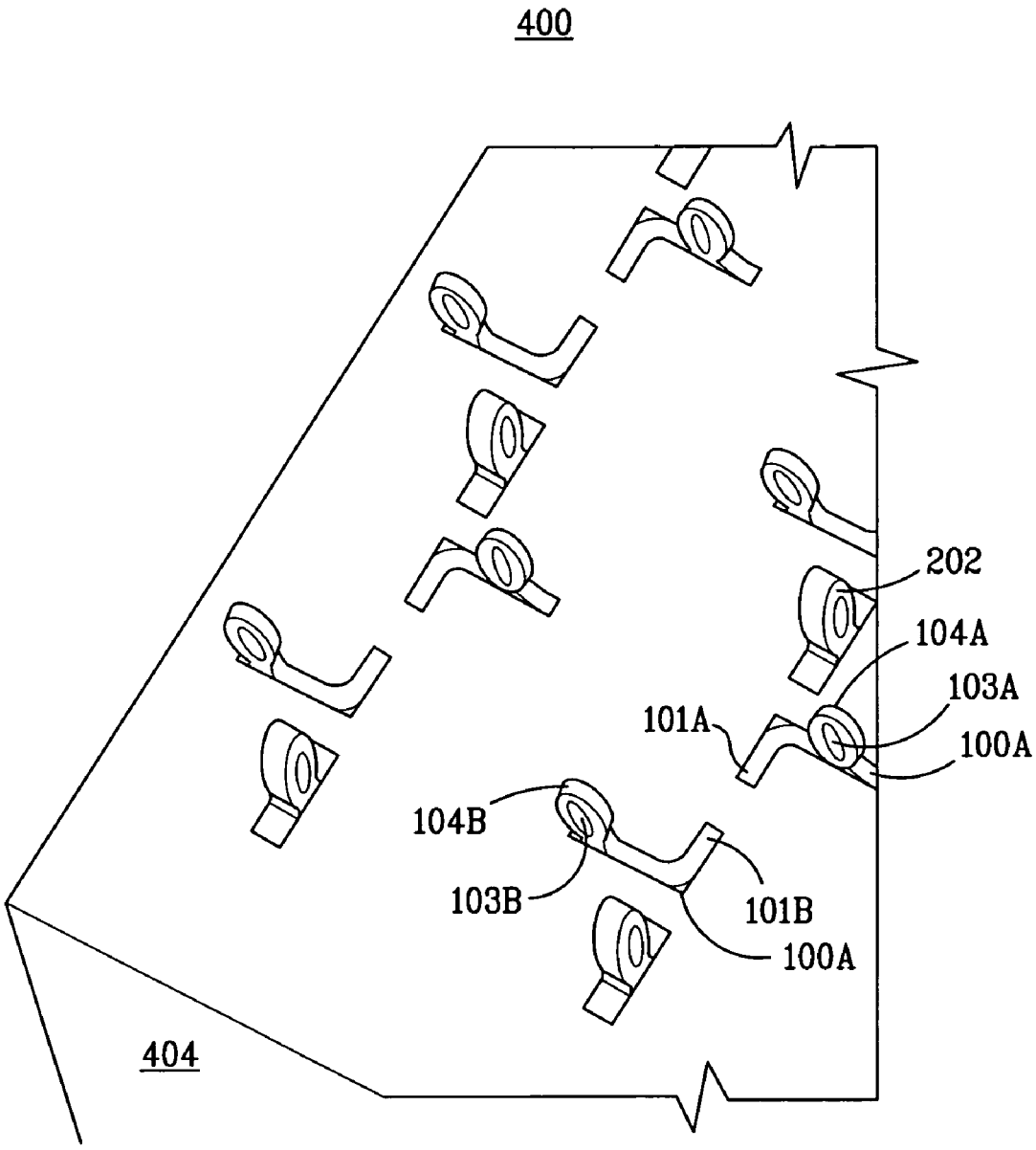

FIGS. 4A and 4B depict the bottom of an illustrative electrical connector 400 in a wide configuration in isometric and bottom views, respectively. Signal contacts 100A-B and ground contacts 202 may be secured within a connector housing 404. In this embodiment, each contact 100A-B within the signal pair may face away from each other. For example, the first contact 100A of the signal pair may be rotated 180° with respect to the second contact 100B of the signal pair such that their respective lead portions 101A-B are between the respective mounting portions 101A-B in a wide configuration.

Also suitable for an orthogonal application, the connector 400 may enable the lead portion 101A-B of each contact 100A-B to be oriented at a substantially 45° angle from the respective mounting portions 103A-B. For example, an imaginary contact plane 411 may align the lead portion 101A of the first contact 100A and the lead portion 101B of the second contact 100B. An imaginary line 412 may extend from the distal tip 104A of the mounting portion 103A of the first contact 100A to distal tip 104B of the mounting portion 103B of the second contact 100B. The contact plane and the imaginary line may interest at an angle 410. The angle 410 measured normal to the contact plane may be substantially 45°. The angle may be substantially 45° within manufacturing tolerance.

Distance D5 may be defined as the distance measured along the contact plane between the center of the lead portion 101A of the first contact 100A and the center of the lead portion 101B of the second contact 100B. Distance D5 may measure the contact pitch as measured center-to-center.

Distance D6 may be defined as the length of the imaginary line 412. Distance D6 may be selected independent of distance D5 such that the angle 110 is maintained. Thus, the distance D6 may be selected according to signal integrity and/or physical design requirements, while maintaining the geometry suitable for orthogonal applications. Because distance D6 may be selected independent of distance D5, connectors of the same family, where contact pitch is defined for the connector family, may be manufactured for specific applications such that distance D6 may be selected to match the impedance of a specific complementary electrical device. In the configuration shown, D6 may represent the maximum hole-to-hole spacing for an orthogonal application with a D5 contact pitch. Such a configuration may increase impedance.

Figure 5:
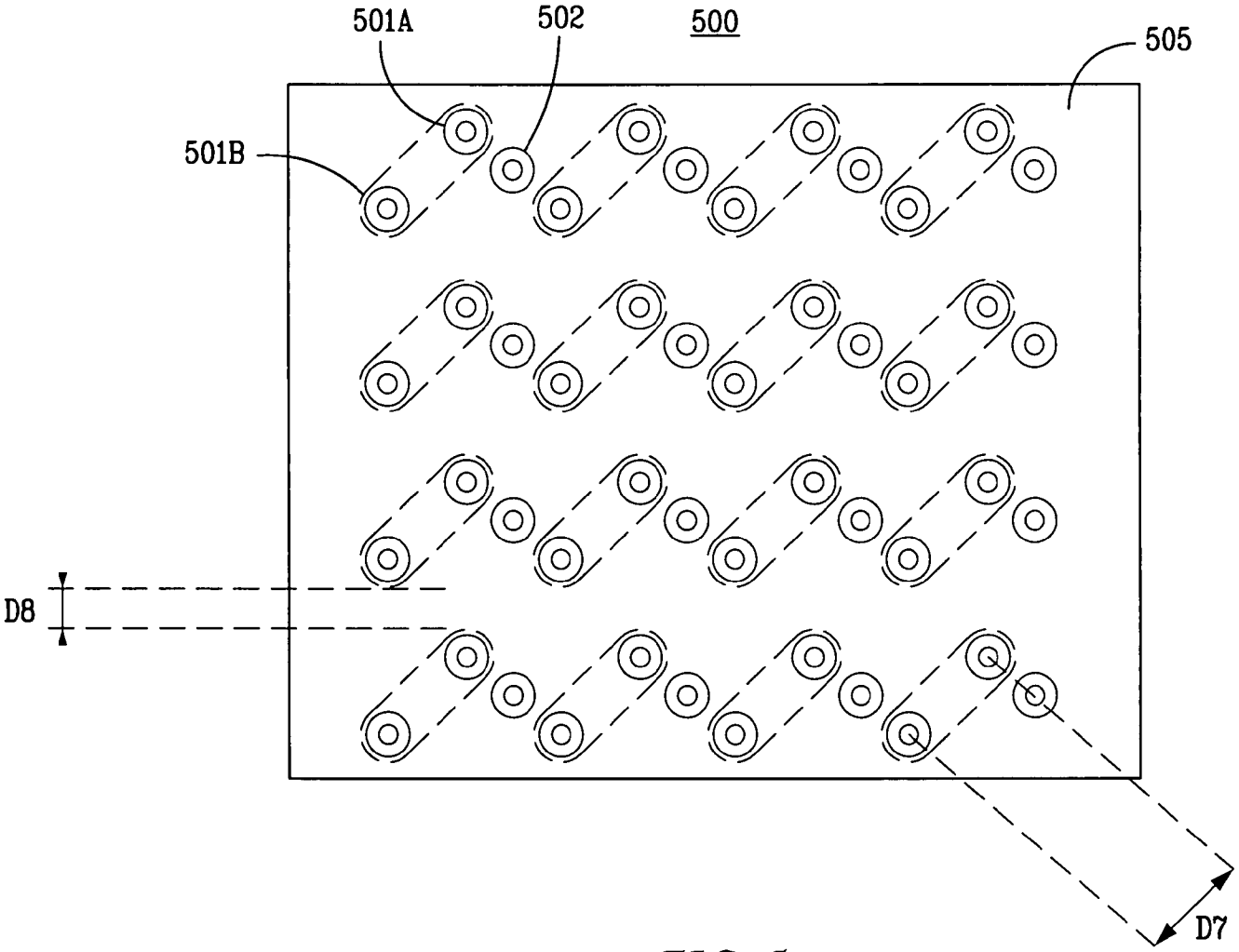
FIG. 5 depicts a illustrative circuit board layout for a wide configuration.

FIG. 5 depicts a illustrative circuit board layout 500 for a wide configuration. Vias 501A-B, 502 may holes in the circuit board 505 oriented for mounting connector 400. For example, via 502 may be a hole within the circuit board 505 that receives the mounting portion of the ground contact 202, and via 501A-B may be a hole within the circuit board 505 that receives mounting portion 103A-B of the signal contacts 100A-B.

The circuit board layout 500 may define a distance D7 between vias 501A-B. Distance D7 may match the distance D6. It may be desirable to select D7 on the basis of signal integrity. For example, it may be desirable to select D7 on the basis of impedance matching.

The circuit board layout 505 may define a distance D8 between rows of vias 501A-B. Distance D8 may provide a width of circuit board that may be used for conductive traces (not shown). It may be desirable to select D8 to ensure adequate physical space for conductive traces. Accordingly, design requirements that influence distance D7 and distance D8 may reflect various implementations for distance D6 of the electrical connector.

Figure 6C:
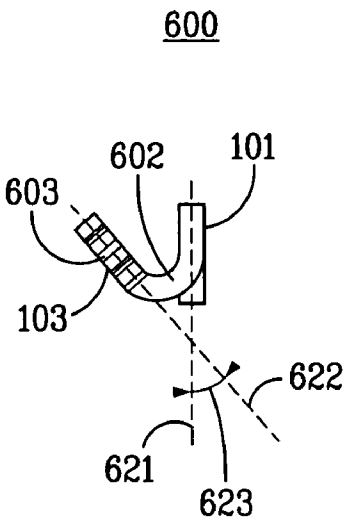
FIGS. 6A-C depict an illustrative electrical contact in front, side, and bottom views, respectively.
Figure 6B:
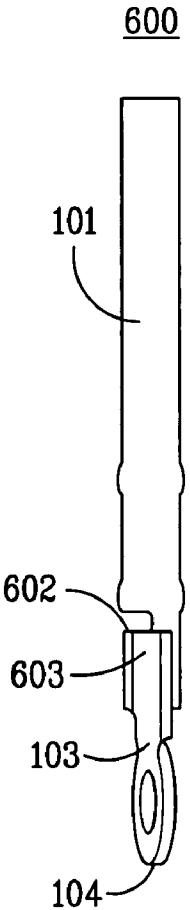
Figure 6A:
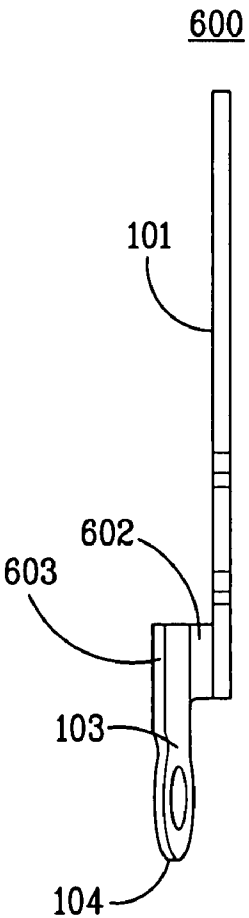

FIGS. 6A and 6B depict an illustrative electrical contact 600 in front, side, and bottom views respectively. The contact 600 may be used for a variable width configuration. The contact may include a lead portion 101 connected to an offset portion 602. The offset portion 602 may define a distal end 603. A mounting portion 103 may extend from the distal end 603 of the offset portion 602. The lead portion 101 and the mounting portion 103 may each define a longitudinal axis. The offset portion 602 may define the distance and relative position of the two axes. The offset portion 602 may be curved. The lead portion 101 may extend in a direction opposite the direction that the mounting portion 103 extends.

The lead portion 101 may define a first imaginary plane 621. The distal end 603 of the offset portion 602 may define a second imaginary plane 622. The first imaginary plane 621 and the second imaginary plane 622 may intersect at an angle 623. The angle 623 may be a non-right, acute angle, for example.

Figure 7B:
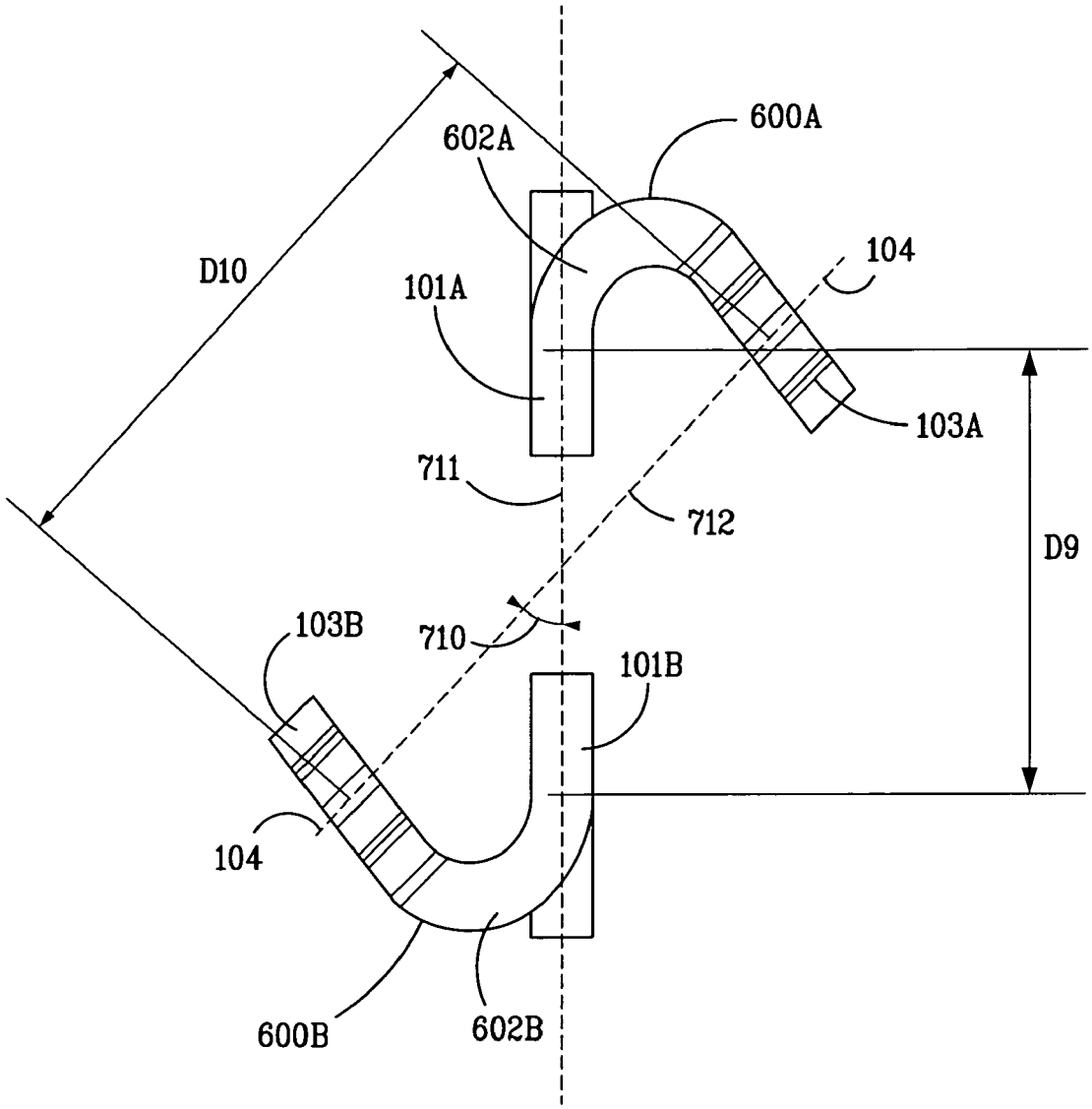

FIG. 7A-B depicts the bottom of an illustrative electrical connector 700 in an intermediate configuration in bottom and close-up views, respectively. Signal contacts 600A-B and ground contacts 202 may be secured within a connector housing 701. Suitable for an orthogonal application, the connector 700 may enable the lead portion 101A-B of each contact 100A-B to be oriented at a substantially 45° angle from the respective mounting portions 103A-B. For example, an imaginary contact plane 711 may align the lead portion 101A of the first contact 100A and the lead portion 101B of the second contact 100B. An imaginary line 712 may extend from the distal tip 104A of the mounting portion 103A of the first contact 100A to distal tip 104B of the mounting portion 103B of the second contact 100B. The contact plane and the imaginary line may interest at an angle 710. The angle 710 measured normal to the contact plane may be substantially 45°. The angle may be substantially 45° within manufacturing tolerance.

Distance D9 may be defined as the distance measured along the contact plane between the center of the lead portion 101A of the first contact 100A and the center of the lead portion 101B of the second contact 100B. Distance D9 may measure the contact pitch as measured center-to-center.

Distance D10 may be defined as the length of the imaginary line 712. Distance D9 may be selected independent of distance D10 such that the angle 710 is maintained. Thus, the distance D10 may be selected according to signal integrity and/or physical design requirements, while maintaining the geometry suitable for orthogonal applications. Because distance D10 may be selected independent of distance D9, connectors of the same family, where contact pitch is defined for the connector family, may be manufactured for specific applications such that distance D10 may be selected to match the impedance of a specific complementary electrical device. D10 may be selected to be greater than, equal to, or less than D9.

In this configuration, D10 may represent an intermediate hole-to-hole spacing. D10 may be changed by varying the offset portion 602, resulting in variations in impedance, cross-talk, and routing channel width independent of the contact pitch D9.

What is claimed:

1. An electrical connector having a contact pitch, the electrical connector comprising:

a connector housing having secured therein a first electrical contact and a second electrical contact, the first and second electrical contacts each comprising:

a lead portion;

an offset portion extending from an end of the lead portion, and a mounting portion extending from a distal end of the offset portion, wherein the lead portion and the distal end of the offset portion define respective imaginary planes that intersect at a non-zero, acute angle; and wherein the respective mounting portions of the first and second contacts define a first distance between them, and the first distance is defined independently of the contact pitch.

2. The electrical connector of claim 1, wherein each of the lead portions defines a respective center thereof, and wherein a first distance defined between the center of the lead portion of the first contact and the center of the lead portion of the second contact is different from a second distance defined between a distal tip of the mounting portion of the first contact and a distal tip of the mounting portion of the second contact.

3. The electrical connector of claim 1, wherein a distance between the mounting portion of the first contact and the mounting portion of the second contact is selected to match an impedance of a complementary electrical device.

4. The electrical connector of claim 1, wherein the connector housing comprises a mounting face for mounting to a substrate, the offset portion of the first contact is flush with the mounting face of the connector housing, and the offset portion of the second contact is flush with the mounting face of the connector housing.

5. The electrical connector of claim 1, wherein the offset portions are curved.

6. The electrical connector of claim 1, wherein each mounting portion defines an eye-of-the-needle configuration.

7. The electrical connector of claim 1, wherein the non-zero, acute angle is a 45-degree angle.

8. An electrical connector comprising:

a connector housing having secured therein a first electrical contact and a second electrical contact, the first and second electrical contacts each comprising:

a respective lead portion that defines a first imaginary plane;

a respective curved offset portion that extends from an end of the lead portion, the offset portion having a distal end that defines a second imaginary plane at right angles to the first imaginary plane; and a respective mounting portion that extends from the distal end of the respective offset portion, the mounting portion defining a distal tip thereof, wherein the lead portion of the first contact aligns with the lead portion of the second contact to define an imaginary contact plane, the distal end of the offset portion of the first contact extends away from the contact plane in a first direction, and the distal end of the offset portion of the second contact extends away from the contact plane in a second direction that is opposite the first direction.

9. The electrical connector of claim 8, wherein the lead portion of the first contact aligns with the lead portion of the second contact to define an imaginary contact plane that forms a non-zero, acute angle, measured normal to the contact plane, with an imaginary line extending from the distal tip of the mounting portion of the first contact to the distal tip of the mounting portion of the second contact.

10. The electrical connector of claim 8, wherein the lead portion of each contact defines a respective center, and a first distance defined between the center of the lead portion of the first contact and the center of the lead portion of the second contact is different from a second distance defined between the distal tip of the mounting portion of the first contact and the distal tip of the mounting portion of the second contact projected normal to the contact plane.

11. The electrical connector of claim 10, wherein the first distance is greater than the second distance.

12. The electrical connector of claim 10, wherein the first distance is less than the second distance.

13. The electrical connector of claim 8, wherein the connector housing comprises a mounting face for mounting to a substrate, the offset portion of the first contact is flush with the mounting face of the connector housing, and the offset portion of the second contact is flush with the mounting face of the connector housing.

* * * * *

UNITED STATES PATENT AND TRADEMARK OFFICE

CERTIFICATE OF CORRECTION

PATENT NO. : 8,057,267 B2
APPLICATION NO. : 12/528906
DATED : November 15, 2011
INVENTOR(S) : Douglas M. Johnescu It is certified that error appears in the above-identified patent and that said Letters Patent is hereby corrected as shown below:

Title Page,
(56) References Cited
OTHER PUBLICATIONS:
Page 1, "U.S. Appl. No. 60/846,711," reference, delete "Mortion." and insert -- Morlion. --.

Signed and Sealed this
Twenty-first Day of February, 2012

David J. Kappos

David J. Kappos
*Director of the United States Patent and Trademark Office*